United States Patent [19]

Hollweck

[11] 4,107,638

[45] Aug. 15, 1978

[54] THERMOSTAT

[75] Inventor: Walter Hollweck, Nuremberg, Germany

[73] Assignee: Inter Control Hermann Kohler Elektrik GmbH & Co. KG, Germany

[21] Appl. No.: 664,024

[22] Filed: Mar. 4, 1976

[30] Foreign Application Priority Data

Mar. 5, 1975 [CA] Canada ..... 221294

[51] Int. Cl.[2] ..... H01H 5/04

[52] U.S. Cl. ..... 337/131; 337/386; 337/390; 337/392

[58] Field of Search ..... 337/126, 131, 135, 386, 337/390, 392, 53, 35, 57, 41, 399; 200/67 D, 67 DA, 246; 219/494

[56] References Cited

U.S. PATENT DOCUMENTS

| | | | |
|---|---|---|---|
| 2,594,750 | 4/1952 | Eskin et al. | 337/392 X |
| 3,117,205 | 1/1964 | Adams | 337/390 |
| 3,525,833 | 8/1970 | Schaff et al. | 200/67 D |
| 3,899,765 | 8/1975 | Daigneault, Jr. | 337/390 X |

FOREIGN PATENT DOCUMENTS

| | | | |
|---|---|---|---|
| 455,354 | 12/1966 | Switzerland | 337/131 |

*Primary Examiner*—Robert J. Hickey
*Attorney, Agent, or Firm*—Craig & Antonelli

[57] ABSTRACT

A thermostat useful for an appliance, which uses a snap action stressed-leaf spring having two stable stressed configurations for the making and breaking of a circuit. Stressing of the spring is provided by differential movement of parts of a heat probe.

13 Claims, 2 Drawing Figures

THERMOSTAT

Figure 1:
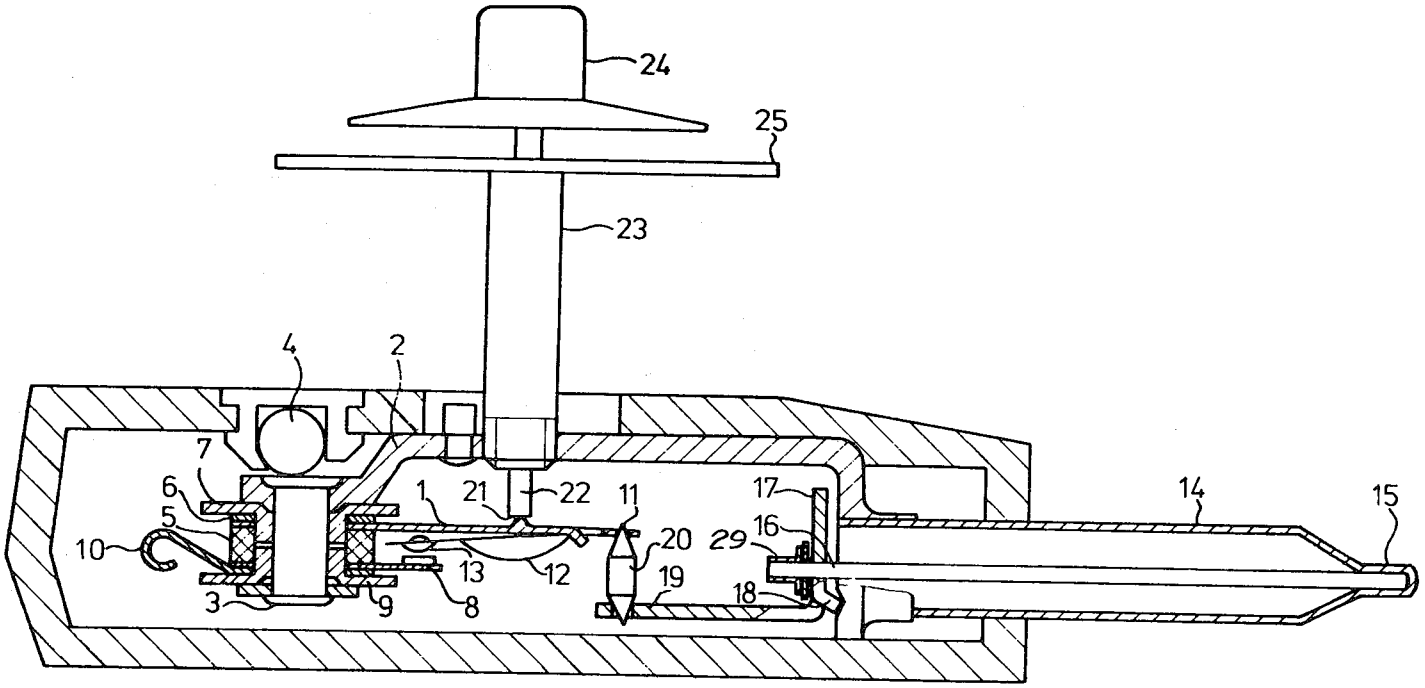

This invention relates to a novel thermostat, particularly useful in household heat appliances such as electric frying pans, or the like.

The electric current in an appliance such as an electric frying pan or the like is usually controlled a well-known bimetallic strip, which makes and breaks a switch as the strip is heated and cooled. Where the specific temperature is to be controlled, a dial is provided, and the position of one of the contacts is moved relative to the other upon turning the dial.

A number of problems have become evident with the use of a bimetallic strip thermostat element. One problem is the creation of radio frequency interferences at the time of breaking of the contacts. Due to the slow movement of one contact from the other, considerable arcing has been found to occur, resulting in electromagnetic radiations and static.

Another problem has been found to be unreliable temperature control. Upon heating of the bimetallic strip from a cold condition, the first break of current has been found to occur at at temperature considerably higher than the nominal temperature desired. Over a series of cycles, it has been found that the turn-on and turn-off temperatures succeeding drop through the nominal temperature with time. Accordingly, the nominal temperature set by a user on the thermostat dial cannot be relied on as being the temperature provided by the appliance.

The present invention provides a substantially more reliable correspondence of the temperature response of the thermostat to the nominal temperature desired; it has a substantially reduced tendency to drop its turn-on and turn-off temperatures with a large number of cycles.

In addition, the present invention is fabricated so as to make and break current contacts very quickly, and thus the aforenoted arcing and resulting radio interference is substantially reduced.

The present invention therefore comprises a spring actuated snap action switch, for providing the fast make and break function. A heat sensor provides differential movement with respect to a direction of actuation of the switch. A linkage is provided for coupling the heat sensing means and the switch. Upon the sensing of a predetermined amount of heat, the switch is caused to snap open by the differential movement, and upon sensing of a decrease in the amount of heat lower than the predetermined amount, the switch is caused to snap closed.

More particularly, the switch is comprised of a metallic leaf spring, which has two stable stressed configurations; upon the application of stress in either of two directions, the spring is caused to snap into one of its two stable configurations. A contact at the end of the spring is electrically conductive with the second contact upon the spring being in one of its stable configurations, and out of contact in its second stable configuration. Means which is moveable with change in temperature is linked to one end of the spring for providing the aforenoted bending stress. A bearing surface, disposed adjacent the leaf spring, provides a surface upon which the stress is developed in one of the bending directions. The bearing surface can be made moveable by means of an external dial, whereupon various temperatures at which point the bending stress occurs can be adjusted, thus providing a variable automatic on-off control for temperature cycling.

A better understanding of the invention will be obtained by reference to the following drawings in which:

FIG. 1 is a sectional view of the thermostat, and

Figure 2:
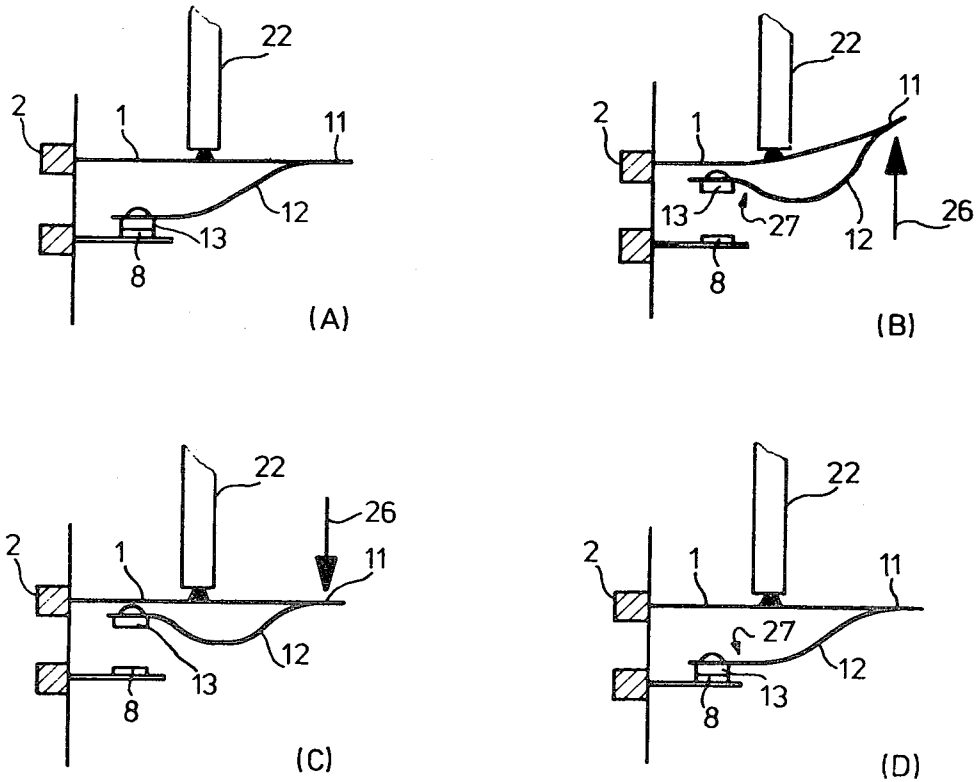

FIG. 2, in views A, B, C, and D, shows the position of the snap-action switch in four different sequential situations, in schematic section.

FIG. 1 shows in section a preferred embodiment of the invention. A first leaf spring 1 is provided, which is held at one end by a support 2. The leaf spring in this embodiment is of electrically conducting material, and preferably the support is of insulating material. Any well known means for supporting the leaf spring can be used, such as by sandwiching it between washers placed around a rivet 3, to which electrical contact is made from a conductor 4 by well known and conventional means. For instance, insulating annular spacer 5 can sandwich leaf spring 1 against a conducting washer 6, which further bears against the shoulder of a conducting cylinder 7 which is in contact with conducting rivet 3, which itself bears against conductor 4. In this way, current flowing through conductor 4 is applied to leaf spring 1.

A switch contact 8 is held by insulating spacer 5 against the shoulder of a non-conducting cylinder 9 which is of similar shape to conducting cylinder 7. The non-conducting cylinder 9 effectively insulates a leaf conductor to which the switch contact 8 is affixed from rivet 3, which holds the entire assembly fixed together. An end of the leaf conductor connected to switch contact 8 is shown as reference 10, to which a second conductor can be connected.

The first leaf spring 1 and switch contact 8 are thus held in insulating spaced relationship.

At the other end 11 of the first leaf spring 1 a second leaf spring 12 is held, with its end in parallel juxtaposition. Preferably, the ends of the two leaf springs are spot welded together. At the other end of the second leaf spring an electrical contact 13 is provided for making and breaking with contact 8.

Leaf spring 12 is fabricated so as to have two stress stable configurations. One of the configurations is shown in FIG. 1, in which the leaf spring 12 is bowed slightly, with its end with contact 13 pressed against leaf spring 1.

In the other configuration, leaf spring 12 is bowed downward with contact 13 pressed against contact 8.

Either of the stressed stable configurations can be obtained by bending the leaf spring 12 towards the direction opposite to the configuration in which it is sitting. Once bending stress has exceeded a critical point, the leaf spring will snap into its opposite stable configuration. In the structure shown, therefore, with the application of stress between contact 13 and end 11 of leaf spring 12, a span action make-break switch is fabricated.

Also affixed to support 2 is heat probe 14, which is fabricated of material which expands with heat, and is intended to be inserted to the position at which the heat is to be sensed. The heat probe 14 is of generally cylindrical form, tapering at its end 15 to accommodate a rod 16. Rod 16 is held at end 15 by threading, welding, or the like; threading provides an adjustment for calibration of the thermostat during testing. Rod 16 is preferably of non-expandable material during heating, or at least has a substantially reduced expansion coefficient relative to heat probe 14.

The important aspect of the heat probe and rod structure is the provision of differential movement between the rod and heat probe, whereby the end of the rod 16 not fixed at end 15 is caused to move relative to support 2, and therefore relative to springs 1 and 12.

A lever 17 is provided to translate axial movement of rod 16 into bending movement of the end 11 of leaf springs 1 and 12. Lever 7, in this embodiment, is bent into a 90° angle, with rod 16 extending through a hole near one end of the lever. A tab 18, bent outwardly from lever 17 bears against an extension of support 2, and acts as a fulcrum for the lever. Means such as tubular rivet and disc 29, fixed to the end of rod 16 bears against the lever 17. Accordingly, axial movement of the rod 16 relative to support 2 results in movement of the end 19 of lever 17 in opposition to end 11 of leaf springs 1 and 12.

An insulating link 20 connects end 19 of lever 17 with end 11 of springs 1 and 12. Link 20 is provided with protrusions swaged into holes in the respective aforenoted ends.

A bearing surface 21 is located adjacent leaf spring 1, against which the leaf spring may bear when bent in that direction. The bearing surface 21 is usefully the end of post 22, which is held by a screw thread in a tube 23 held by support 2. The end of post 22 can usefully be provided with a knob 24, which cooperates with a dial surface 25, which can contain temperature numerals and reference markings. Control over the temperature of operation is thus afforded.

In operation, the heat probe is located at the heat position to be controlled. The probe expands with heat differentially with respect to rod 16, causing outward movement of rod 16 relative to support 2. The end of the rod which is linked to lever 17 bears against lever 17, causing clockwise rotation of the lever about tab 18. Since the major portion of lever 17 extends to the left of tab 18 where it bears against support 2, mechanical advantage is obtained, and a small movement of rod 16 is translated into a substantially greater movement of the end of lever 19. Upward (in this figure) movement of the end 19 of lever 17 is translated through link 20 to the end 11 of leaf springs 1 and 12.

After sufficient movement has occurred, leaf spring 1 bears against bearing surface 21 of post 22, and substantial stress is begun to be applied to spring 1, and also spring 12. A full discussion of the operation of the switch will be given below, but suffice to say at this point that axial movement of rod 16 resulting from heating and cooling of heat probe 14 will result in breaking or making of the electrical contacts 13 and 18. Current is therefore stopped, or allowed to flow through a single pole single throw on-off switch, in a rapid, snap-action.

The operation of leaf springs 1 and 12 will now be described with reference to FIG. 2. In this Figure, the relative positions of support 2, leaf springs 1 and 12, contacts 13 and 8, and post 22 are as before.

As noted earlier, leaf spring 12 has two stressed stable configurations. In diagram A of FIG. 2, the thermostat is considered to be cold, and leaf spring 12 is in one stable stress configuration, separated from leaf spring 1, with its contact 13 bearing against contact 8. There are insufficient external stresses against either of the springs to cause a change in their stable configuration. Post 22 is spaced from spring 1.

In configuration B, however, sufficient heat has been detected by heat probe 14, to cause movement of the end of lever 17, which, as described earlier, causes resulting movement of end 11 of both springs 1 and 12. The application of bending stress is shown at arrow 26.

When sufficient bending stress has been applied, contact is made between spring 1 and post 22, causing a resulting bending stress on spring 12 in opposite direction to the forces on contact 13 and at end 11. When spring 12 has passed its maximum stable resistance point, it suddenly flips into its second stressed stable configuration in the direction shown by dashed arrow 27. The contacts 13 and 8 are thus caused to break suddenly, and with a minimum of sparking.

With the break in current to the heating element of the appliance, the heat probe 14 is caused to cool. In configuration C, bending movement is applied at end 11 in the direction shown by arrow 26 which results from movement of the aforenoted rod 16 due to cooling. With the end of spring 1 held by support 2, bending of spring 1, and bearing of contact 13 against spring 1, bending stress in the opposite direction to that in configuration B is now applied to leaf spring 12. When sufficient bending stress has been endured by leaf spring 12, it suddenly flips into its first stable configuration as shown at D, movement of leaf spring 12 following dashed arrow 27. Sudden snap action contact with a minimum of sparking is thus provided, with contacts 13 and 8 now in electrical contact.

It is therefore evident that heating and cooling of heat probe 14 results in sudden snap action change of spring 12 from one stable stressed configuration to another, effectively breaking or making a thermostatic electrical contact.

Change in the position of break of contact is clearly obtainable by change in the amount of movement of spring 1 at which point the irrestible stress is provided on spring 12. Since this position is determined by bearing surface 21 of post 22, adjustment in the height of the bearing surface from the spring 1 provides an adjustment in the temperature at which the contacts will be forced to open. In FIG. 1, it will be seen that rotation of knob 24 will cause a screw rotation and movement of bearing surface 21 away or toward spring 1, thus providing control of the switching off temperature of the thermostat.

Since the switching on temperature is related to the amount of oppositely-directed stress applied to spring 12, and since this is roughly a constant amount of opposite stress relative to the previous stress applied thereto, the turning-on temperature relative to the turning-off temperature is very closely controlled.

It will also be seen that due to the fact that heat is not directly applied to the leaf springs, as they are in the previous known bi-metallic strips, heat does not affect the spring characteristics of the leafs, and there will be very little droop in the turn-on and off cycling temperature during use of the thermostat.

In addition, since the leaf springs are not subjected to heat, they can be optimized in their electrical conducting characteristics and mechanical spring-snap open and close mechanical characteristics.

Spring 12 can be caused to have two stable stress configurations by dimpling it centrally, whereby a central portion will have a slightly longer length than two side portions. It will therefore be stable in two positions, in which the dimple extends outwardly from either plane surface of the spring.

Accuracy and calibration of the thermostat is affected by the dimple radius, the fulcrum angle, and the traverse space through which the lever and spring is allowed to move prior to the application of the aforenoted bending stress on spring 12. In addition, if spring 16 is screwed into heat probe 14, its position also affects calibration.

It will now be seen that various alternatives of structure can be provided and still obtain some of the advantages desired. For instance, a less desirable, but still acceptable alternative to the heat probe is the provision of a bimetallic strip optimized for movement, but not necessarily for electrical conduction, which moves the end 11, the junction of leaf springs 1 and 12. Other forms of heat probes could be used, internal mechanical configurations, etc. The temperature control could be provided by means of a wedge operated sliding bearing surface 21, rather than screw operated as shown. In addition, while housing 28 is provided for removal of the thermostat from an appliance without danger to a user, the entire device could be built directly into an appliance, and housed by the housing of the appliance itself.

With substantially reduced temperature overshoot than that obtained in the usual bi-metallic trip type thermostat, and with substantially reduced sparking and resulting radio frequency interference due to the snap action operation of the switch, as well as very little droop of temperature cycling from the nominal temperature set, a substantially improved thermostat over the prior art is obtained.

The embodiments of the invention in which an exclusive property or privilege is claimed are defined as follows:

1. A thermostat comprising:

(a) an electrical spring switch having first and second stressed stable operative states and carrying a first electrical contact;

(b) support means for retaining said switch at one end thereof;

(c) a second electrical contact mounted on said support means in opposition to said first electrical contact;

(d) a heat probe rod axially movable with change in temperature with respect to said support means; and (e) a lever, the end of said heat probe rod being linked to one leg of the lever, the fulcrum of the lever being closer to the probe rod than to the end of the other leg of the lever, and the end of said other leg of the lever being linked to the other end of the switch opposite said one end thereof whereby movement of said lever by said heat probe rod are transmitted to said other end of said switch to motivate said switch between said first and second stressed stable operative states.

2. A thermostat as defined in claim 1 in which the lever is bent about 90° adjacent the fulcrum, further including an electrically insulating link coupling the end of said other leg of the lever to said other end of the switch.

3. A thermostat as defined in claim 2 in which the probe rod is disposed in a plane parallel to the plane of the switch, and said one leg is disposed in a plane orthogonal to the axis of the probe rod adjacent the end thereof.

4. A thermostat as defined in claim 1, further including an adjustable post, threaded through a hole in said support, and located in an interfering position with the switch to provide a bearing surface for stressing the switch and defining its position whereupon it can be snapped to said one of its stable states.

5. A thermostat as defined in claim 2 in which the switch is a snap action type.

6. A thermostat comprising:

(a) an electrical spring switch having first and second stressed stable operative states; a support position, and a link pressure position, (b) a support for the switch, retaining the switch at the support position, (c) a heat probe rod axially movable with change in temperature with respect to the support;

(d) a lever, the end of the probe rod being linked to one leg of the lever, the fulcrum of the lever being closer to the probe rod than to the end of the other leg of the lever, the end of said other leg of the lever being linked to the link pressure position of the switch; and (e) a hollow tubular expandable housing for the heat probe rod, connected at an open end to an extension of said support, the heat probe rod extending through and being connected to the other end of the housing, the lever being bent about 90° and the rod being linked to one leg thereof, the fulcrum comprising a tab extending from the lever and bearing against said support, further including an electrically insulating link coupling the end of the other leg of the lever with the other end of the switch, whereby upon expansion and contraction of the housing, causing movement of the rod, the lever is caused to rock about its fulcrum, thereby exerting bending pressure against the other end of the switch via the insulating link.

7. A thermostat comprising:

(a) a first electrically conductive leaf spring, having one end fixed to a support, (b) a second electrically conductive leaf spring, fixed at one end to the other end of the first leaf spring, and stressed into a first stressed stable configuration in approximate juxtaposition with the first leaf spring, and having a second stressed stable configuration at an angle to the first leaf spring, (c) an electrical contact supported by the other end of the second leaf spring, (d) a bearing surface disposed adjacent the first leaf spring, (e) actuating means moveable relative to said support with change in temperature, connected to the junction of said first and second springs, for moving said junction against and away from the bearing surface, whereupon stress can be applied to the first and second leaf springs, causing the second leaf spring to snap to its second stable configuration.

8. A thermostat as defined in claim 7, in which said actuating means comprises a heat probe rod, moveable with respect to the support, a lever, the end of the probe rod being linked to the lever, the fulcrum of the lever being closer to the position of the probe rod than to the other end of the lever, and the other end of the lever linked to the junction of the first and second leaf springs.

9. A thermostat as defined in claim 7, in which the bearing surface is comprised of one end of a post adjustable in its distance from the first spring.

10. A thermostat as defined in claim 8, in which the lever is bent about 90° adjacent the fulcrum, further including an electrical insulator coupling said other end of the lever with said junction.

11. A thermostat as defined in claim 8, further including a hollow tubular expandable housing for the heat probe rod, connected at an open end to an extension of said support, the heat probe rod extending through and being connected to the other end of the housing, the lever being bent about 90° the rod being linked thereto, whereby upon expansion and contraction of the housing, causing movement of the rod, the lever is caused to rock about its fulcrum, the fulcrum comprising a tab extending from the lever and bearing against said support, further including an electrically insulating post coupling the other end of the lever with said junction, the configuration of said support being such as to stress all defined elements against each other by the first leaf spring.

12. A thermostat as defined in claim 11, in which the bearing surface is comprised of the end of a post, thread adjustable through said support relative to the first leaf spring, further including a second contact fixed to said support but insulated from the first spring, spaced from the first contact when the second leaf spring is in its first stressed stable configuration, but located in contacting interference with the first contact when the second leaf spring is in its second stressed stable configuration.

13. A thermostat as defined in claim 12, further including an insulating housing for all the defined elements but through which the heat probe housing extends, means for conducting current to the first leaf spring and the second contact, and means for allowing adjustment of the bearing surface distance from the first leaf spring.

* * * * *